US009708830B2

(12) United States Patent
Henderson et al.

(10) Patent No.: US 9,708,830 B2
(45) Date of Patent: Jul. 18, 2017

(54) HEATED INFLATABLE EXERCISE CHAMBER WITH GAS-PERMEABLE INNER MEMBRANE

(71) Applicant: Hot Pod Yoga Limited, London (GB)

(72) Inventors: Maxwell Kenneth Henderson, London (GB); Nicholas John Clinton Higgins, London (GB)

(73) Assignee: HOT POD YOGA LIMITED, London (GB)

( * ) Notice: Subject to any disclaimer, the term of this patent is extended or adjusted under 35 U.S.C. 154(b) by 0 days.

(21) Appl. No.: 15/031,863

(22) PCT Filed: Oct. 21, 2014

(86) PCT No.: PCT/GB2014/053133

§ 371 (c)(1),
(2) Date: Apr. 25, 2016

(87) PCT Pub. No.: WO2015/059458

PCT Pub. Date: Apr. 30, 2015

(65) Prior Publication Data

US 2016/0279499 A1 Sep. 29, 2016

Related U.S. Application Data

(63) Continuation of application No. 14/147,788, filed on Jan. 6, 2014, now abandoned.

(30) Foreign Application Priority Data

Oct. 24, 2013 (GB) ..... 1318794.3

(51) Int. Cl.
*E04H 15/20* (2006.01)
*E04H 15/12* (2006.01)
(Continued)

(52) U.S. Cl.
CPC ..... *E04H 15/20* (2013.01); *E04H 15/12* (2013.01); *E04H 15/14* (2013.01);
(Continued)

(58) Field of Classification Search
CPC ... E04H 15/20; E04H 15/22; E04H 2015/202; E04H 15/205; E04H 15/207
See application file for complete search history.

(56) References Cited

U.S. PATENT DOCUMENTS 2,649,101 A * 8/1953 Suits ..... E04H 15/22 135/20.2
3,844,339 A * 10/1974 Kranz ..... E04H 15/20 165/46
(Continued)

FOREIGN PATENT DOCUMENTS

CA 2524310 A1 4/2006
GB 1333223 A 10/1973
(Continued)

OTHER PUBLICATIONS

PCT International Preliminary Report on Patentability, Application No. PCT/GB2014/053133 filed Oct. 21, 2104, dated Apr. 26, 2016.
(Continued)

*Primary Examiner* — David R Dunn
*Assistant Examiner* — Danielle Jackson
(74) *Attorney, Agent, or Firm* — MacMillan, Sobanski & Todd, LLC

(57) ABSTRACT

An inflatable exercise chamber (100) for performing exercise therein, the inflatable exercise chamber comprising (100); one or more walls (102) defining an enclosed space, wherein the wall (102) comprises an inner membrane (110, 210) and an outer membrane (112) defining an inflatable cavity (114) therebetween, wherein the inner membrane (110) of the wall is a gas-permeable membrane (210).

19 Claims, 4 Drawing Sheets

(51) Int. Cl.
*E04H 15/14* (2006.01)
*E04H 15/10* (2006.01)

(52) U.S. Cl.
CPC ..... *A63B 2225/62* (2013.01); *A63B 2225/64* (2013.01); *E04H 15/10* (2013.01); *E04H 2015/202* (2013.01); *E04H 2015/207* (2013.01)

(56) References Cited

U.S. PATENT DOCUMENTS

| | | | | |
|---|---|---|---|---|
| 4,021,972 | A * | 5/1977 | Choate | E04B 1/169 52/2.15 |
| 4,024,803 | A | 5/1977 | Linecker | |
| 4,102,352 | A * | 7/1978 | Kirkham | E04H 15/32 135/115 |
| 6,438,900 | B1 * | 8/2002 | Page | E04H 6/04 52/2.16 |
| 7,836,905 | B2 * | 11/2010 | Tarter | E04H 15/10 135/91 |

FOREIGN PATENT DOCUMENTS

| | | | |
|---|---|---|---|
| JP | H11229671 | A | 8/1999 |
| JP | 2000050744 | A | 2/2000 |
| SE | 423560 | B | 5/1982 |

OTHER PUBLICATIONS

Patents Act 1977: Search Report under Section 17, Application No. GB1318794.3 dated Dec. 24, 2013.

PCT International Search Report and the Written Opinion, Application No. PCT/GB2014/053133 filed Oct. 21, 2104 dated Feb. 6, 2015.

* cited by examiner

HEATED INFLATABLE EXERCISE CHAMBER WITH GAS-PERMEABLE INNER MEMBRANE

This application is the National Phase of International Application PCT/GB2014/053133 filed Oct. 21, 2014, which designated the U.S. That International Application was published in English under PCT Article 21(2) on Apr. 30, 2015 as International Publication Number WO 2015/059458A1. PCT/GB2014/053133 claims the benefit of U.K. Patent Application No. 1318794.3 filed Oct. 24, 2013 and U.S. patent application Ser. No. 14/147,788 filed Jan. 6, 2014. Thus, the subject nonprovisional application also claims priority to U.K. Patent Application No. 1318794.3 filed Oct. 24, 2013 and U.S. patent application Ser. No. 14/147,788 filed Jan. 6, 2014. The disclosures of all of these applications are incorporated herein by reference.

This invention relates to an inflatable exercise chamber for performing exercise therein and particularly, but not exclusively, relates to an inflatable exercise chamber comprising one or more walls comprising a gas-permeable inner membrane configured to prevent the formation of condensation on the inner membrane

INTRODUCTION

Current trends in the health and fitness sectors have shown a rise in the number of people participating in "hot" exercise classes, such as hot yoga, hot pilates and hot ballet. In order to create a suitable environment for a hot exercise class, a fitness studio would typically be heated to around 40° C. with a relative humidity level of approximately 40%.

Such environmental conditions necessitate that the fitness studios be equipped with heaters and humidifiers, which can limit the availability of such classes. The environmental requirements often mean that much condensation is formed on the walls and ceilings of the fitness studio during the exercise class which may inadvertently reduce the humidity levels required for the classes and result in liquid droplets falling on an occupant. As such, it is desirable to conduct the classes in a self-contained chamber that may be specifically used for hot exercise classes. Such a chamber may more readily control the internal environment at optimum levels.

Furthermore in order to meet increasing demands of the health and fitness sector, fitness class providers may wish to offer exercise classes at locations that would not typically be equipped to meet the requirements of the classes, for example at offices and hotels. In this way, it is desirable to provide a portable exercise chamber that may be installed in a wide variety of locations.

The present invention seeks to address these issues.

STATEMENT OF INVENTION

According to an aspect of the present invention there is provided an inflatable exercise chamber for performing exercise therein, the inflatable exercise chamber including one or more walls defining an enclosed space, wherein the wall comprises an inner membrane and an outer membrane defining a cavity, for example an inflatable cavity, therebetween, wherein the inner membrane of the wall is a gas-permeable membrane. The inflatable exercise chamber may be heated.

The heated inflatable exercise chamber may be configured to permit gas to flow between the environment external to the inflatable exercise chamber and the environment internal to the inflatable exercise chamber, for example, by passage across the gas-permeable membrane of the wall. The flow of gas across the gas-permeable membrane of the wall may prevent the formation of condensation on the inner surface of the wall. The gas-permeable inner membrane may be configured with a permeability that is just sufficient to prevent the formation of condensation on the inner membrane of the wall. The inner membrane may be fabricated from ripstop nylon.

The inner membrane may be formed from a plurality of membrane portions joined together. The joins between the membrane portions may be configured to permit gas to flow between the inflatable cavity and the environment internal to the inflatable exercise chamber. The joins may be discontinuous. The joins may comprise stitched seams. The joins may be configured to direct a flow of gas across the surface of the inner membrane, for example to prevent the formation of condensation on the surface of the inner membrane which faces the environment internal to the exercise chamber. The inner membrane may be at least partially ribbed, for example the ceiling and/or walls of the inner membrane may comprise a plurality of membrane portions joined together to form a ribbed surface.

The heated inflatable exercise chamber may comprise at least one opening configured to allow access into and out of the chamber. The opening may be provided with a cover.

The heated inflatable exercise chamber may comprise a light configured to illuminate the environment internal to the chamber. The light may be disposed within the cavity of the wall.

The heated inflatable exercise chamber may comprise a heater configured to heat the environment internal to the heated inflatable exercise chamber. The heated inflatable exercise chamber may comprise a humidifier configured to humidify the environment internal to the heated inflatable exercise chamber. The heated inflatable exercise chamber may comprise a fan configured to flow gas between the environment external to the heated inflatable exercise chamber and cavity of the wall. For example, the fan may inflate, maintain or deflate the cavity.

The heated inflatable exercise chamber may comprise one or more control devices configured to control the pressure and/or mass flow rate of gas into and out of the cavity. The control device may comprise one or more pressure sensors, mass flow sensors, temperature sensors and/or humidity sensors. The control devices may be configured to control automatically the inflation and/or deflation of the heated inflatable exercise chamber. The control device may be configured to control the temperature and/or the humidity of the environment internal to the heated inflatable exercise chamber.

According to another aspect of the present invention, there is provided a heated inflatable exercise chamber for performing exercise therein. The inflatable exercise chamber comprises one or more walls at least partially defining an enclosed space. The walls comprise an inner membrane and an outer membrane defining an inflatable cavity therebetween. The inner membrane is formed from a plurality of membrane portions joined together. The joins between the membrane portions are configured to permit gas to flow between the inflatable cavity and the environment internal to the inflatable exercise chamber to prevent the formation of condensation on the surface of the inner membrane.

To avoid unnecessary duplication of effort and repetition of text in the specification, certain features are described in relation to only one or several aspects or embodiments of the invention. However, it is to be understood that, where it is technically possible, features described in relation to any aspect or embodiment of the invention may also be used with any other aspect or embodiment of the invention.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1:
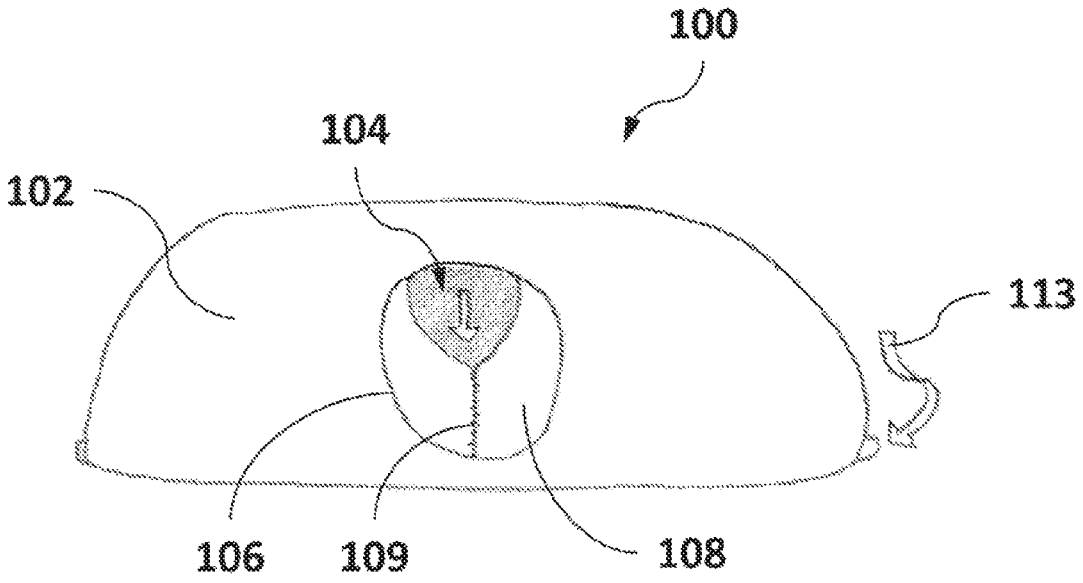
FIG. 1 shows an external view of an inflatable exercise chamber comprising an opening.

An inflatable exercise chamber 100 according to an embodiment of the present invention is shown in FIG. 1. The inflatable exercise chamber 100 comprises one or more walls 102 that define an enclosed space 104 within the inflatable exercise chamber 100. The exercise chamber 100 is suitable for performing a variety of exercises therein for example yoga and pilates, or variants such as "hot" yoga.

In the embodiment shown in FIG. 1, the inflatable exercise chamber 100 comprises a single wall 102 that defines the enclosed space 104 within the inflatable exercise chamber 100. However, in another embodiment, the inflatable exercise chamber 100 may comprise any number of walls 102 that are configured to define the enclosed space 104 within the inflatable exercise chamber 100. For example, in another embodiment, the inflatable exercise chamber 100 may comprise a plurality of individual walls 102, which may form sidewalls, a floor and/or a roof that may be arranged to define the enclosed space within the inflatable exercise chamber 100.

In the embodiment shown in FIG. 1, the inflatable exercise chamber 100 comprises an opening 106 configured to allow access into and out of the inflatable exercise chamber 100. The opening 106 is provided with a cover 108 that may be opened and closed using one or more fastening means 109, for example a zip or any other appropriate fastening means.

Figure 2:
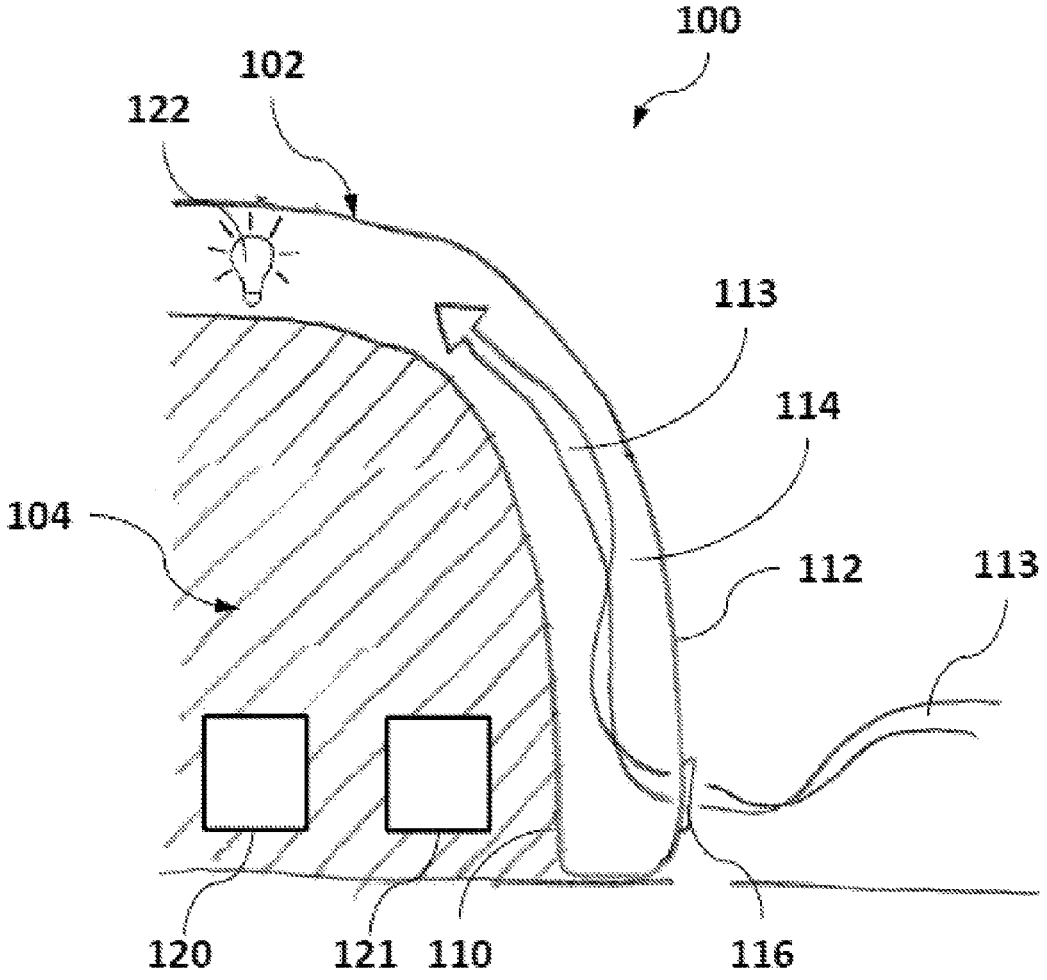
FIG. 2 shows a partial cross section of a wall of the inflatable exercise chamber depicting a flow of a gas from the environment external to the inflatable exercise chamber to an inflatable cavity defined by an inner membrane and an outer membrane of the wall.

FIG. 2 shows a partial cross section of the wall 102 of the inflatable exercise chamber 100. The wall 102 comprises an inner membrane 110 and an outer membrane 112. The wall 102 comprises an inflatable cavity 114 that is defined by the inner membrane 110 and the outer membrane 112. The wall 102 is configured such that when a gas, for example air, is pumped into the cavity 114, the wall 102 inflates. The air pressure generated in the cavity 114 of the wall 102 provides structural rigidity to the inflatable exercise chamber 100. As such, the inflatable exercise chamber 100 may be lightweight and easy to erect. The inflatable exercise chamber 100, upon deflation, may be rolled and packed into a suitable container, which allows the inflatable exercise chamber 100 to be easily transported between locations.

The inflatable exercise chamber 100 comprises one or more fans 116 configured to flow air 113 between the environment external to the inflatable exercise chamber 100 and cavity 114 of the wall 102. In the embodiment shown in FIG. 2, the fan 116 is provided in the outer membrane 112 and is configured to flow air 113 into the cavity 114 from the environment external to the inflatable exercise chamber 100. In another embodiment, however, the fan 116 may be provided in any other location on or near the inflatable exercise chamber 100. The fan 116 may be configured to flow air from the cavity 114 into the environment internal and/or external to the inflatable exercise chamber 100.

Figure 3:
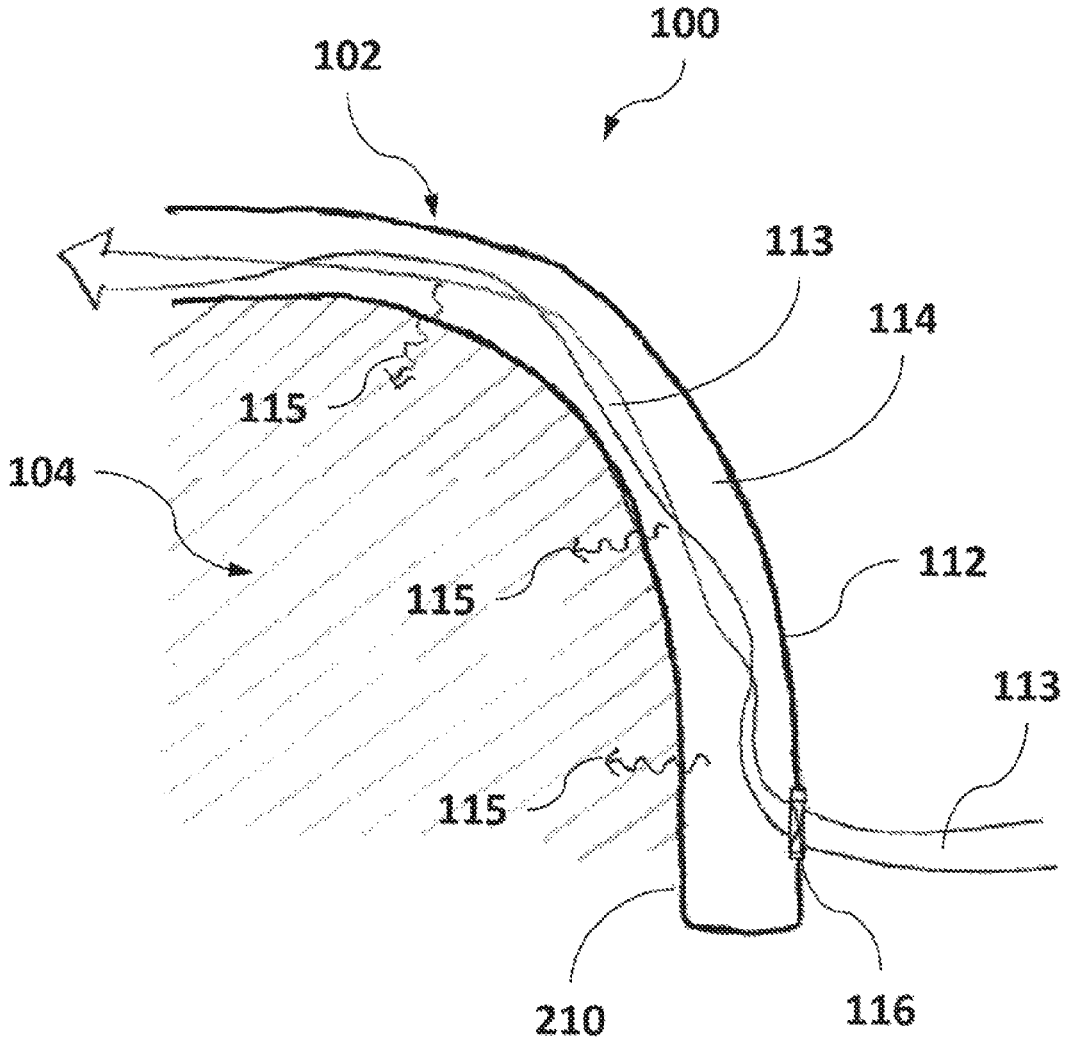
FIG. 3 shows a partial cross section of the wall of the inflatable exercise chamber depicting a flow of a gas from the inflatable cavity to the internal and external environment of the inflatable exercise chamber.

In the embodiment shown in FIG. 3 the wall 102 comprises a gas-permeable inner membrane 210. It may be appreciated, however, that wall 102 may comprise a gas-permeable outer membrane. The inflatable exercise chamber 100 is configured to permit air 115 to flow between the inflatable cavity 114 and the environment internal to the inflatable exercise chamber 100 by passage across the gas-permeable inner membrane 210.

During hot exercise classes, the temperature and the humidity of the environment internal to the inflatable exercise chamber 100 is usually much warmer and more humid that those conditions external to the inflatable exercise chamber 100. Such conditions promote the formation of condensation on the inner surface of the wall 102 of the inflatable exercise chamber 100. A build-up of condensation is unsightly and unpleasant to the users of the inflatable exercise chamber 100. The flow of air 115 across the gas-permeable inner membrane 210 of the wall 102 prevents the formation of condensation on the inner surface of the wall 102 by creating an air barrier between the gas-permeable inner membrane 210 and the environment internal to the inflatable exercise chamber 100.

The gas-permeable inner membrane 210 may be fabricated from any material that permits the passage of gas across its surface, for example ripstop nylon. In order to maintain the necessary pressure within the cavity 114, the mass flow rate of the air 115 across the gas-permeable inner membrane 210 may be controlled. Furthermore, if the mass flow rate of the air 115 across the gas-permeable inner membrane 210 is too great, the environment internal to the inflatable exercise chamber 100 may be disturbed. Consequently, once the inflatable exercise chamber 100 has been erected, the flow of air 113 into the cavity is approximately balanced with the flow of air 115 across the gas-permeable inner membrane 210. The gas-permeable inner membrane 210 may be configured with a permeability that is just sufficient to prevent the formation of condensation on the gas-permeable inner membrane 210 of the wall 102. Furthermore, the mass flow rate of air 115 across the gas-permeable inner membrane 210 may be dependent upon the air pressure within the cavity 104.

Figure 4A:
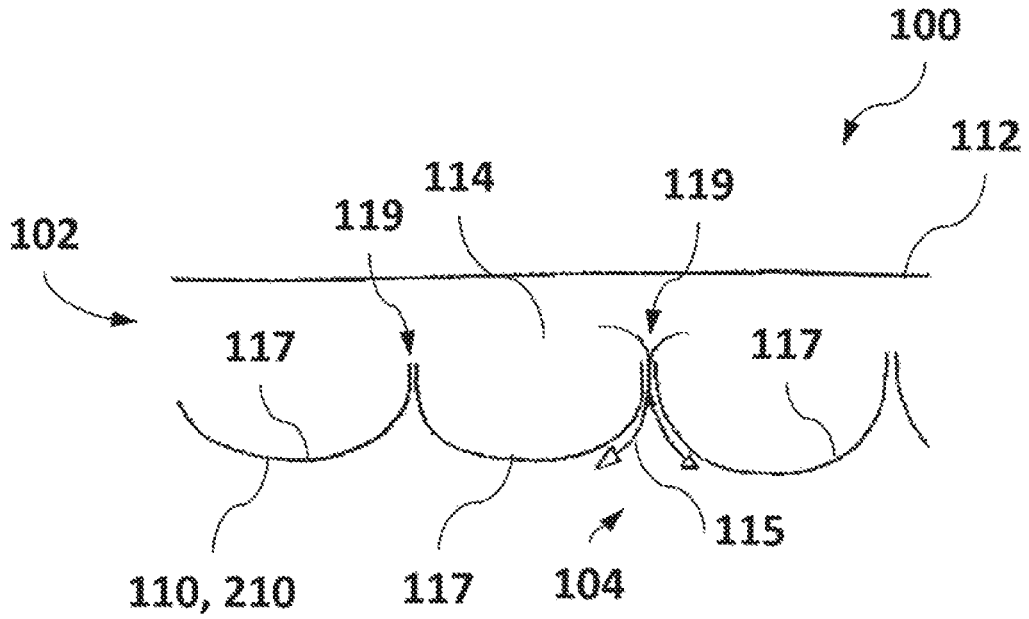
FIG. 4*a* shows a partial cross section of the wall of the inflatable exercise chamber depicting a flow of a gas from the inflatable cavity to the internal environment of the inflatable exercise chamber by passage across a first type of join between portions of the inner membrane.
Figure 4B:
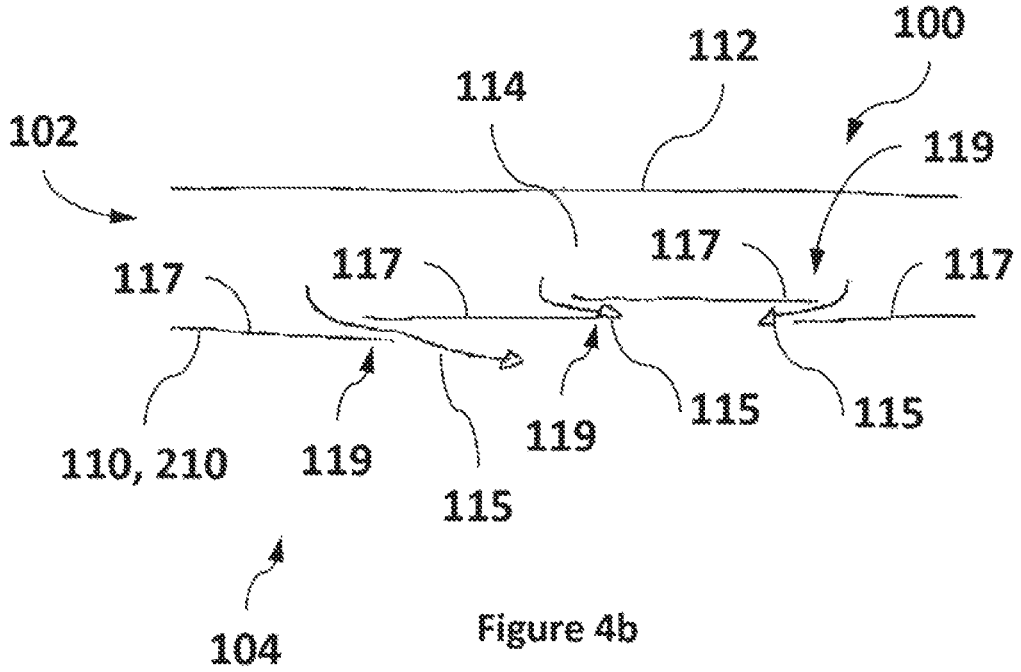
FIG. 4*b* shows a partial cross section of the wall of the inflatable exercise chamber depicting a flow of a gas from the inflatable cavity to the internal environment of the inflatable exercise chamber by passage across a second type of join between portions of the inner membrane.

FIGS. 4*a* and 4*b* show partial cross sections of the wall 102 of the inflatable exercise chamber 100. As depicted in FIG. 4*a*, the inner membrane 110, 210 may comprise a plurality of membrane portions 117 joined together. Joins 119 between the membrane portions 117 are configured to permit air 115 to flow between the inflatable cavity 114 and the enclosed space 104 within the inflatable exercise chamber 100. The membrane portions 117 may be joined by any appropriate means, for example by the use of stitching, welding, adhesive and/or any other joining technique. The joins 119 between the membrane portions 117 may be discontinuous, e.g. with one or more gaps such that air 115 may flow between gaps in the join 119. In those examples where the inner membrane 110, 210 is made from a fabric, the joins may comprise stitched seams and the gaps may be between neighbouring stitches or groups of stitches. The gaps may be configured to direct air flow 115 in a desired direction so as to prevent the formation of condensation on the inner membrane 110, 210.

The configuration of the joins 119 may be such that the flow rate of air 115 is different at different portions 117 of the inner membrane 110, 210, for example the joins 119 in a ceiling of the inner membrane 110, 210 may be configured to allow more air to flow across the surface of inner membrane 110, 210 than the joins 119 in a sidewall of the inner membrane 110, 210, e.g. by virtue of more and/or bigger gaps in the ceiling joins. In this manner the joins may be configured to prevent the formation of condensation in those areas of the healed inflatable exercise chamber 100 which are more susceptible to the formation of condensation or where condensation may be more problematic, e.g. on the ceiling. By contrast, one or more of the joins 119 may be configured to not permit the flow of air 115 between the inflatable cavity 114 and the enclosed space 104 within the inflatable exercise chamber 100, e.g. in places where condensation is less likely to occur or is less likely to be undesirable, such as on the sidewalls.

FIG. 4*a* shows an example of the wall 102 of the inflatable exercise chamber 100 where the inner membrane 110, 210 comprises membrane portions 117 joined together to form a ribbed inner membrane 110, 210. The joins 119 between the membrane portions 117 are configured to direct air flow across the surface of each of the ribs of the inner membrane 110, 210.

FIG. 4*b* show another example of the wall 102 of the inflatable exercise chamber 100 where the inner membrane 110, 210 comprises membrane portions 117 joined together to form a generally flat inner membrane 110, 210. The joins 119 between the membrane portions 117 are configured to direct air flow in a direction parallel to the surface of the inner membrane 110, 210. As depicted in FIG. 2, the inflatable exercise chamber 100 may further comprise one or more heaters 120 and/or humidifiers 121 configured respectively to heat and humidify the environment internal to the inflatable exercise chamber 100 to the required levels. The air barrier created between the gas-permeable inner membrane 210 and the environment internal to the inflatable exercise chamber 100 helps to maintain the required conditions. The heaters 120 and/or humidifiers 121 may be disposed inside the inflatable exercise chamber 100. Additionally or alternatively, the heaters 120 and/or humidifiers 121 may be disposed outside the inflatable exercise chamber 100. The fan 116 and/or one or more additional fans may be used to flow warm and/or humid air from the heaters 120 and/or humidifiers 121 disposed outside the inflatable exercise chamber 100 to the environment internal to the inflatable exercise chamber 100. For example, warm and/or humid air may be provided to the environment internal to the inflatable exercise chamber 100 through the gas-permeable inner membrane 210.

The inflatable cavity 114 insulates the internal environment from the outside. This insulation reduces the heat loss to the environment and thereby reduces the heat input required to reach the desired temperature inside the exercise chamber 100. Furthermore, the temperature differential across the inflatable cavity 114 also serves to prevent condensation forming on the inner membrane 110, 210. Condensation tends to form on cold surfaces and the insulating effect of the cavity 114 helps to increase the temperature of the inner membrane surface, thereby reducing the likelihood of condensation forming.

As also depicted in FIG. 2, the inflatable exercise chamber 100 may further comprise one or more lights 122 configured to illuminate the environment internal to the inflatable exercise chamber 100. The lights 122 may be disposed within the cavity 114 of the wall 102.

What is claimed is:

1. An inflatable exercise chamber for performing exercise therein, the inflatable exercise chamber comprising one or more walls at least partially defining an enclosed space, wherein;

the one or more walls comprise an inner membrane and an outer membrane defining an inflatable cavity therebetween;

at least the inner membrane of the one or more walls is a gas-permeable membrane;

the inner membrane is formed from a plurality of membrane portions joined together with one or more joins; and the joins between the membrane portions are configured to both (1) permit gas to flow from the inflatable cavity to the enclosed space of the inflatable exercise chamber and (2) direct a flow of gas across an inner surface of the inner membrane facing an environment internal to the inflatable exercise chamber.

2. An inflatable exercise chamber according to claim 1, wherein the inflatable exercise chamber is configured to permit gas to flow from the inflatable cavity to the enclosed space of the inflatable exercise chamber by passage across the gas-permeable membrane of the one or more walls.

3. An inflatable exercise chamber according to claim 2, wherein the flow of gas across the gas-permeable membrane of the one or more walls prevents the formation of condensation on the inner membrane of the one or more walls.

4. An inflatable exercise chamber according to claim 1, wherein the inflatable exercise chamber comprises at least one opening configured to allow access into and out of the inflatable exercise chamber.

5. An inflatable exercise chamber according to claim 4, wherein the opening is provided with a cover.

6. An inflatable exercise chamber according to claim 1, wherein the inflatable exercise chamber further comprises a light configured to illuminate the environment internal to the inflatable exercise chamber.

7. An inflatable exercise chamber according to claim 6, wherein the light is disposed within the inflatable cavity of the one or more walls.

8. An inflatable exercise chamber according to claim 1, wherein the inflatable exercise chamber further comprises a heater configured to heat the enclosed space of the inflatable exercise chamber.

9. An inflatable exercise chamber according to claim 1, wherein the inflatable exercise chamber further comprises a humidifier configured to humidify the enclosed space of the inflatable exercise chamber.

10. An inflatable exercise chamber according to claim 1, wherein the inflatable exercise chamber further comprises a fan configured to flow gas from the enclosed space to the inflatable exercise chamber and the inflatable cavity of the one or more walls.

11. An inflatable exercise chamber according to claim 10, wherein the fan is configured to inflate, maintain, and/or deflate the inflatable cavity.

12. An inflatable exercise chamber according to claim 1, wherein the gas-permeable inner membrane is configured with a permeability that prevents the formation of condensation on the inner membrane of the one or more walls.

13. An inflatable exercise chamber according to claim 1, wherein at least the inner membrane is fabricated from ripstop nylon.

14. An inflatable exercise chamber according to claim 1, wherein the joins are discontinuous.

15. An inflatable exercise chamber according to claim 1, wherein the joins comprise stitched seams.

16. An inflatable exercise chamber according to claim 1, wherein the inner membrane is ribbed.

17. An inflatable exercise chamber according to claim 1, wherein the joins are configured such that flow rate of gas through the join at a first location is greater than the flow rate of gas through the join at a second location.

18. A method of inflating an exercise chamber for performing exercise therein comprising the steps of:

providing an exercise chamber having one or more walls at least partially defining an enclosed space, wherein (1)the one or more walls include an inner membrane and an outer membrane defining an inflatable cavity therebetween, (2) at least the inner membrane of the wall is a gas-permeable membrane, (3) the inner membrane is formed from a plurality of membrane portions joined together with one or more joins, and (4) the joins between the membrane portions are configured to both (a) permit gas to flow from the inflatable cavity to the enclosed space of the inflatable exercise chamber and (b) direct a flow of gas across an inner surface of the inner membrane facing an environment internal to the inflatable exercise chamber; and inflating the inflatable cavity.

19. The method of claim 18 further including a step of permitting gas flow though the joins from the inflatable cavity to the enclosed space of the inflatable exercise chamber, which is performed by permitting the flow rate of gas through the join at a first location to be greater than the flow rate of gas through the join at a second location.

* * * * *